US006448482B2

(12) United States Patent
Cerro

(10) Patent No.: US 6,448,482 B2
(45) Date of Patent: Sep. 10, 2002

(54) CYMBAL SLEEVE

(76) Inventor: Frank D. Cerro, 3 Franklin La., Kinnelon, NJ (US) 07405

( * ) Notice: Subject to any disclaimer, the term of this patent is extended or adjusted under 35 U.S.C. 154(b) by 0 days.

(21) Appl. No.: 09/772,798

(22) Filed: Jan. 30, 2001

Related U.S. Application Data

(60) Provisional application No. 60/179,995, filed on Feb. 3, 2000.

(51) Int. Cl.[7] ..... G10D 13/02
(52) U.S. Cl. ..... 84/422.3; 84/453; 84/422.2
(58) Field of Search ..... 84/422.3, 422.2, 84/453

(56) References Cited

U.S. PATENT DOCUMENTS

| | | | | |
|---|---|---|---|---|
| D262,073 S | | 12/1981 | Zimmerman | D3/73 |
| D283,464 S | | 4/1986 | Ogden | D3/30.1 |
| 4,666,110 A | | 5/1987 | Prouty | 248/122 |
| 5,088,377 A | | 2/1992 | Delecaris | 84/422.3 |
| 5,165,552 A | | 11/1992 | Muhlbauer | 211/13 |
| 5,520,462 A | * | 5/1996 | Clark | 383/37 |
| 5,922,980 A | * | 7/1999 | Arteaga | 84/411 M |

FOREIGN PATENT DOCUMENTS

JP 2000354507 * 12/2000

* cited by examiner

*Primary Examiner*—Shih-Yung Hsieh
(74) *Attorney, Agent, or Firm*—McNair Law Firm, P.A.

(57) ABSTRACT

A protection device for cymbals wherein a cymbal sleeve having a top portion and bottom portion, joined along their perimeter, form a pocket. A mouth being formed by the unjoined portion of the perimeters of the respective portions for receiving a cymbal. The top portion having a top post opening generally located within its center and the bottom portion having a bottom post opening generally located within its center. The top post opening and bottom post opening being aligned with the cymbal opening for allowing the post of a cymbal case or a cymbal stand to be received through the bottom portion, cymbal, and top portion for securing the cymbal and protective cymbal sleeve in the cymbal case. An inner cushion can be placed between two cymbals so that a plurality of cymbals can be placed in one pocket and the cymbals are prevented from contacted each other.

31 Claims, 5 Drawing Sheets

CYMBAL SLEEVE

FIELD OF THE INVENTION

The present invention relates to protective coverings for percussion instruments and, more specifically, a soft form cymbal sleeve for the protection of cymbals and capable of being used in a cymbal case or a cymbal stand. The application claims priority on copending application Ser. No. 60/179,995 filed on Feb. 3, 2000 incorporated by reference.

BACKGROUND OF THE INVENTION

To a percussionist, cymbals are a critical aspect of the instruments used during a performance. Cymbals are generally manufactured from bronze having many different proportions of copper and tin. The shape, surface, and embedded pattern of a cymbal are critical to its sound. Therefore, protection of these characteristics of the cymbal is critical to preserving the look, sound, and feel of a cymbal. For example, a cymbal can lose its initial bright and shimmery sound and become dark and earthy due to dirt build-up, oxidation or other dampening effects on the cymbal. When the grooves of a cymbal are filled in with a foreign substance, the look, feel and sound of the cymbal is changed. When grooves are worn or abrasions occur to the cymbal, the sound and feel are again changed. Many cymbal manufacturers even provide a specialized cleaning solution specifically design for their particular cymbal.

Among musical performers, it is frequently necessary to transport cymbals to and from different locations. During transportation, the hazards of abnormal wear and tear occur to these instruments. In particular, cymbals are particularly susceptible to wear and tear and other hazards of transportation since they are fragile and generally carried stacked one on-top another. Since cymbals have different diameters (ranges can be more than from 5 inches to 22 inches) they develop noticeable rings where some of the grooves of a lower cymbal are rubbed smooth by the edge of a higher cymbal of stacked cymbals when they bounce around and rub against each other during transportation. Such abrasion not only wears down the grooves on a cymbal, but also can take off a special coating of the cymbal used to enhance the cymbal's sound.

Traditionally, cymbal cases have been used for carrying cymbals from location to location. These cases generally have a center post for securing cymbals stacked one on-top another. However, no provision has been made for preventing the cymbals from coming into contact with one another within the cymbal case. Such abrasions between cymbals has been termed "travel-bounce." An example of such a case is shown in U.S. Design Patent D283,464. However, this patent does not contain any means for protecting the cymbals from contacting each other while in the case. Additionally, U.S. Design Patent D262,073 discloses another cymbal holder that, again, does not show any means for protecting the cymbals from damaging each other in the holder. U.S. Pat. No. 5,088,377 discloses a cymbal carrier and protector, but is limited to the hi-hat cymbals left on a hi-hat stand.

Accordingly, it is an object of the present invention to provide a cymbal protector that provides protection for individual cymbals.

Another object of the present invention is to provide individual protection for cymbals when stored with multiple cymbals stacked upon each other.

Another object of the present invention is to provide individual protection for cymbals as they are being placed on or removed from a cymbal stand.

Another object of the present invention is to provide a solution to "travel-bounce."

Another object of the present invention is to provide a solution to "travel-bounce" while utilizing a traditional cymbal case without having to make modifications to the cymbal cases.

SUMMARY OF THE INVENTION

The above objectives are accomplished according to the present invention by providing a cymbal sleeve having a top portion with a bottom portion joined along a portion of its perimeter to the corresponding perimeter of the top portion forming a pocket. A mouth is formed by the unjoined portion of the perimeters of the top and bottom portions for receiving a cymbal. The top portion having a top post opening generally located within the center of the top portion and the bottom portion having a bottom post opening generally located within the center of the bottom portion. The top post opening and bottom post opening are aligned with the cymbal opening for allowing the post of a cymbal case or cymbal stand to be received through the bottom portion, cymbal, and top portion for securing the cymbal and protective cymbal sleeve in the cymbal case or on a cymbal stand.

Additionally, the cymbal sleeve may contain closure means, such as Velcro®, disposed along the interior edge of the top and bottom portions near the mouth for closing the mouth. The closure means can have a locking member and an anchor member. The anchor member being carried by the top portion and the locking member being carried by the bottom portion so that when the locking member and the anchor member are engaged, the top portion is secured to the bottom portion, thereby closing the mouth for providing a securely closed cymbal sleeve for holding cymbals.

Alternatively, the cymbal sleeve may contain a closure flap carried by one of the portions disposed near the mouth. The closure flap being foldable over the other portion for closing the mouth. The closure flap has a secured end and a free end wherein the secured end is carried by the bottom portion. The closure flap uses a securing strip having a locking member and an anchor member. The anchor member being carried by the top portion and the locking member carried by the free end of the closure flap, so that when the locking member and the anchor member are engaged, the closure flap is secured to the top portion providing a securely closed cymbal sleeve for holding cymbals.

Alternatively, the cymbal sleeve may contain a closure strap carried by the bottom portion disposed near the mouth. The closure strap being foldable over the top portion for closing the mouth. The closure strap has a secured end and a free end wherein the secured end is carried by the bottom portion. The closure strap uses a securing strip having a locking member and an anchor member. The anchor member being carried by the top portion and the locking member carried by the free end of the closure strap so that when the locking member and the anchor member are engaged, the closure strap is secured to the top portion for providing a securely closed cymbal sleeve holding cymbals.

The cymbal sleeve can also contain a top post opening reinforcement member and a bottom post opening reinforcement member for providing protection against wear due to the action of mounting and dismounting the cymbal sleeves on cymbal case posts or cymbal stand posts.

The present invention also discloses a method for protecting a cymbal comprising the steps of providing a cymbal, providing a pocket having a top protection portion and a bottom protection portion with each portion having a center opening and the openings being aligned one with the other, placing a cymbal within the pocket, and placing the cymbal and the pocket upon a cymbal case post or a cymbal stand. The cymbal is then secured to the cymbal case post and then repeated for a plurality of cymbals.

A case housing can be included with any of the above embodiments so that a post carried generally in the center of the interior of the case housing receives the cymbal and pocket. A case top can be placed on the case housing to completely enclose the cymbal sleeves mounted within the case housing. Securing straps are then used to secure the case top to the case housing.

The cymbal sleeve, may also contain an inner cushion for placement between two cymbals for allowing two cymbals to be placed in a single cymbal sleeve. Thereby, a method of protection cymbals is disclosed comprising the steps of providing a plurality of cymbals, placing an inner cushion between the cymbals, and placing the cymbals and the inner cushions within the cymbal sleeve pocket.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

Reference is made to the attached drawings, wherein elements having the same reference numeral designations represent like elements throughout and wherein.

DETAILED DESCRIPTION OF THE PREFERRED EMBODIMENT

Figure 1:
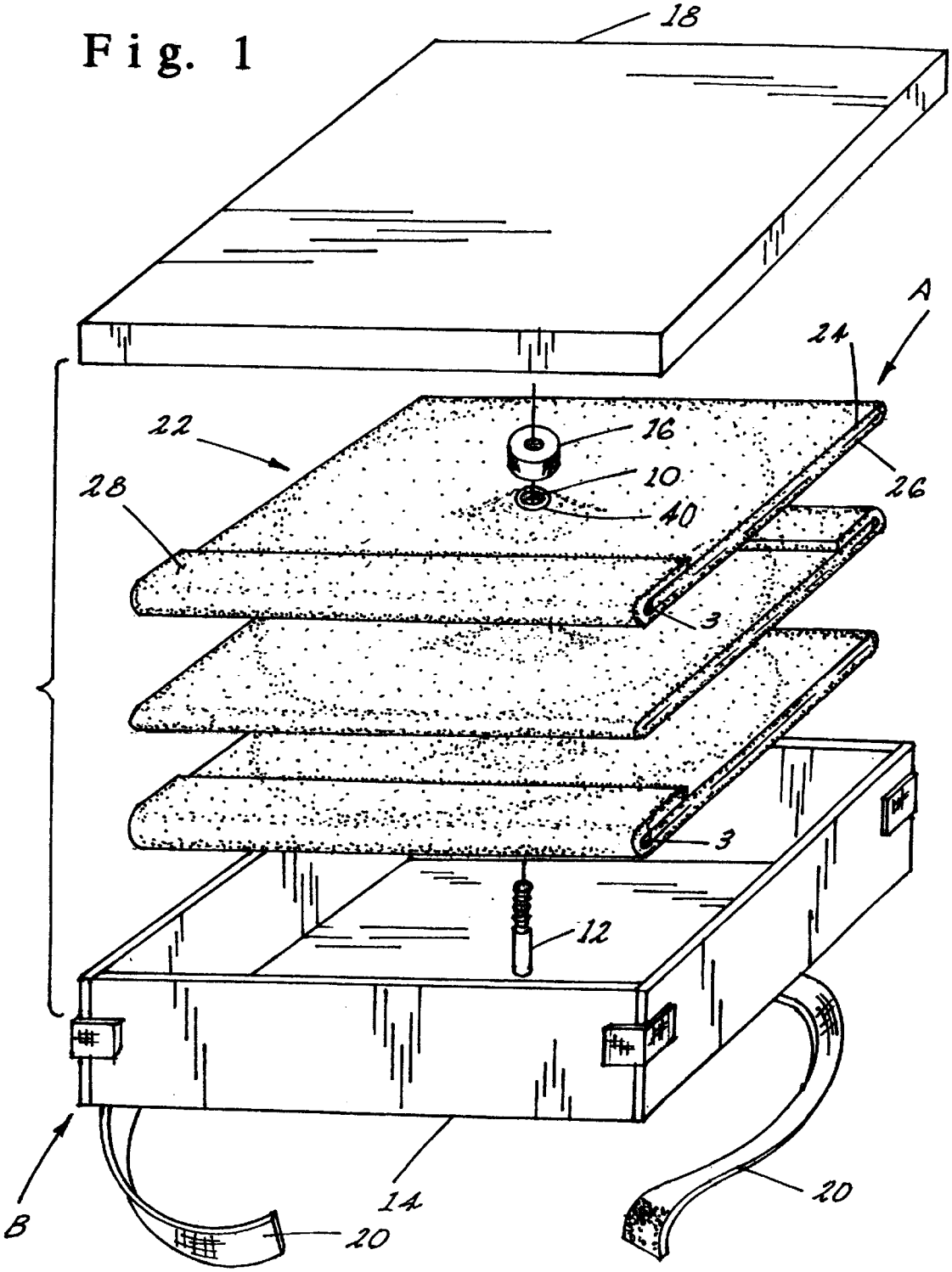
FIG. 1 is a perspective drawing of a cymbal case showing cymbal sleeves within the case.

Referring now to FIG. 1, the invention will be described in more detail. A cymbal sleeve A is generally provided for protecting a cymbal. A plurality of cymbal sleeves, each containing a cymbal can be stacked within a cymbal storage case B. Cymbal sleeve A contains a centrally located post opening 10 through the cymbal sleeve allowing securing post 12 of a case housing 14 to be received through this opening. The cymbal also has an opening that is disposed in the center of the cymbal for receiving, among other things, a securing post 12 in a cymbal case. Once the cymbal sleeve, containing the cymbal, is placed upon the post, a securing nut 16 is used to secure the cymbal sleeve and cymbal within the case housing. A case top 18 can be placed upon case housing 14 and secured with straps 20 to close the cymbal case. Therefore, when multiple cymbals within multiple cymbal sleeves are secured in a case, the cymbals do not come in contact with each other and abrasion or "travel bounce" between the cymbals is prevented.

Figure 2:
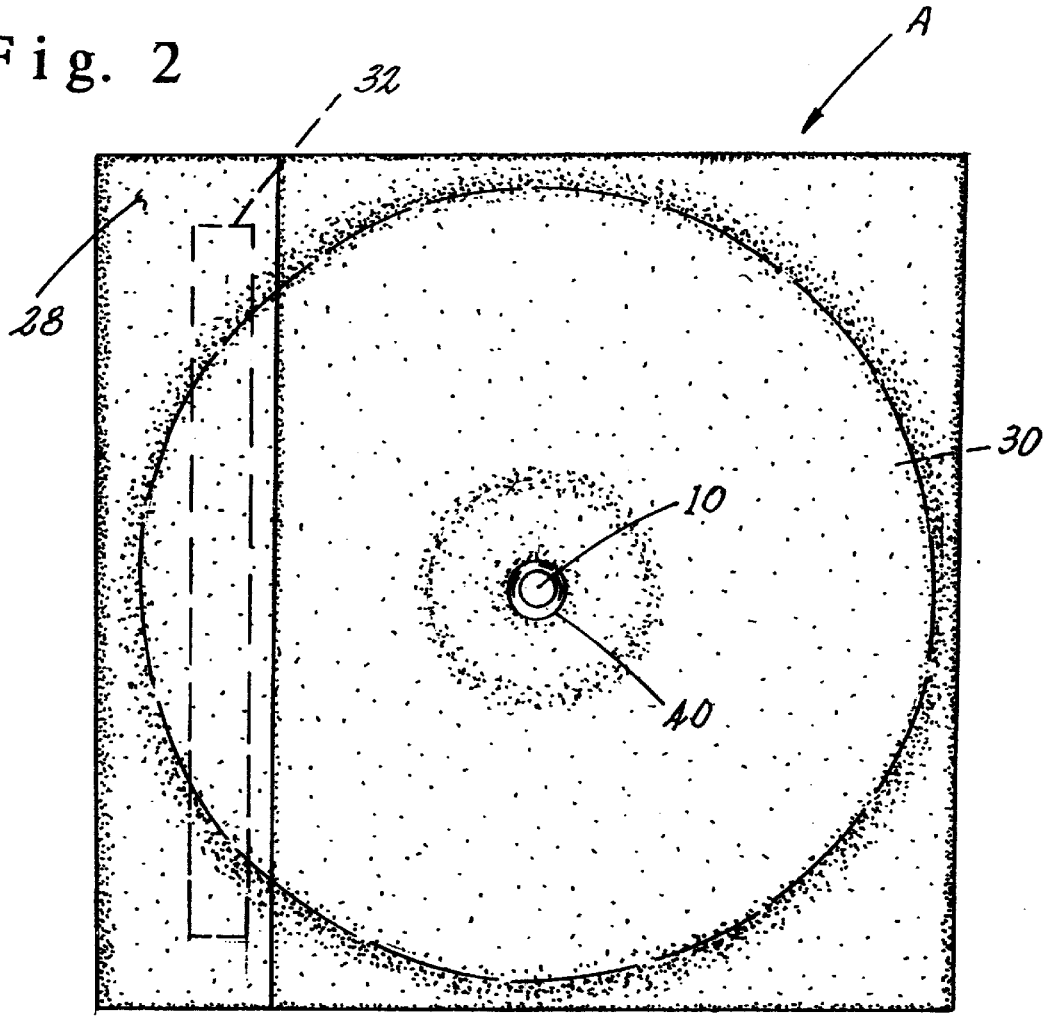
FIG. 2 is a top view of a cymbal contained with a single cymbal sleeve.

The cymbal sleeve itself comprises a pocket 22 formed by a top portion 24 and bottom portion 26 joined along three sides of their perimeters. A post opening 10 is provided within the top portion disposed generally in the center of the pocket and runs through both the top and bottom portions. Opening 10 within the top portion can be protected with a reinforcement member 40 to protect the opening from wear and tear when placing and removing the cymbal sleeve from posts. Additionally, a closure flap 28 may be carried by the bottom portion to be folded over the unjoined top portion to close the cymbal sleeve for completely containing a cymbal. FIG. 2 shows a top view of cymbal sleeve A with a cymbal 30 contained within. The top post opening 10 of the cymbal sleeve is illustrated in alignment with the center hole in a cymbal for receiving a securing post of a cymbal case or stand. Flap 28 is shown engaging a securing strip 32 for securing the flap closed.

Figure 3:
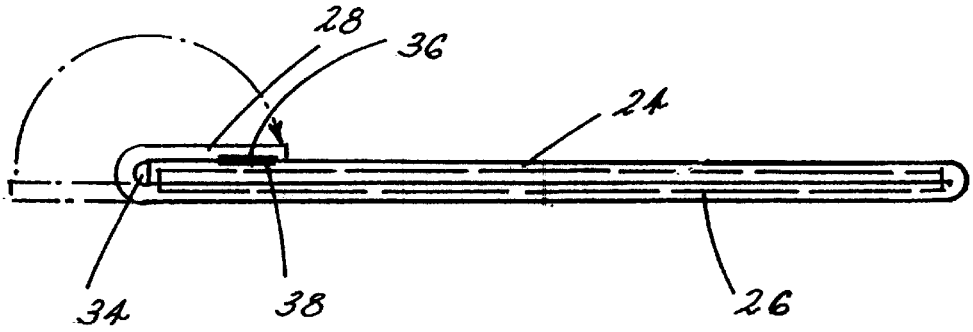
FIG. 3 is a side view of a cymbal sleeve.

FIG. 3 illustrates the securing strip, flap and interior pocket in more detail. Flap 28 carried by bottom portion 26 is shown in a closed position folded over top portion 24 securing the cymbal within the sleeve. The cymbal is received within the cymbal sleeve through the mouth or main opening 34. Once received, flap 28 is moved from an open position to a closed position. The free end of the flap carries a locking member 36 that engages an anchor member 38, carried by the top portion, to secure the flap and close the cymbal sleeve. The locking member and anchor member can be Velcro®, buttons, snaps, loop and hook, or other fastening means. Once secured, the cymbal is prevented from falling out of the cymbal sleeve.

Figure 3A:
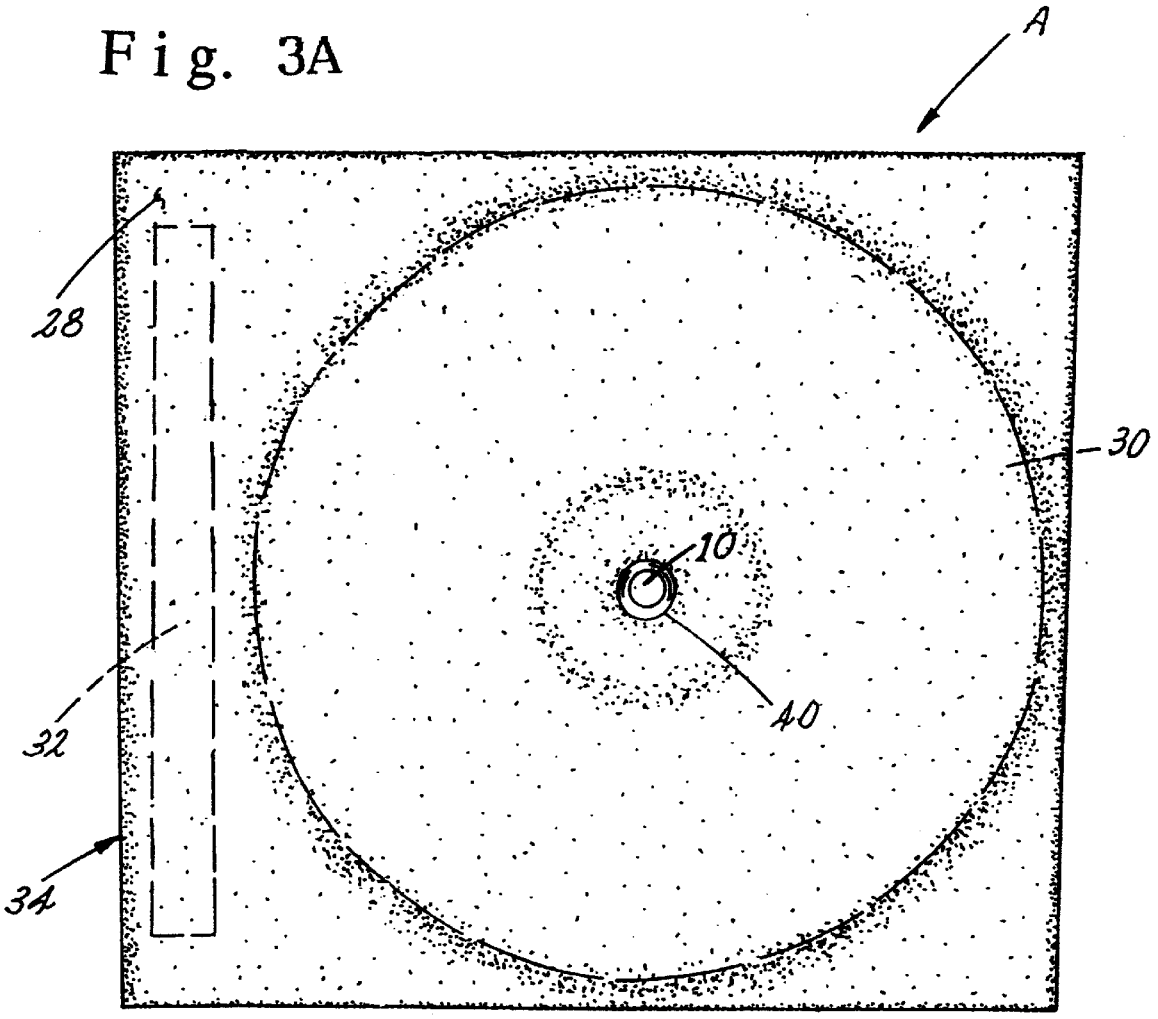
FIG. 3A is a top view of an alternative embodiment of a single cymbal sleeve.
Figure 3B:
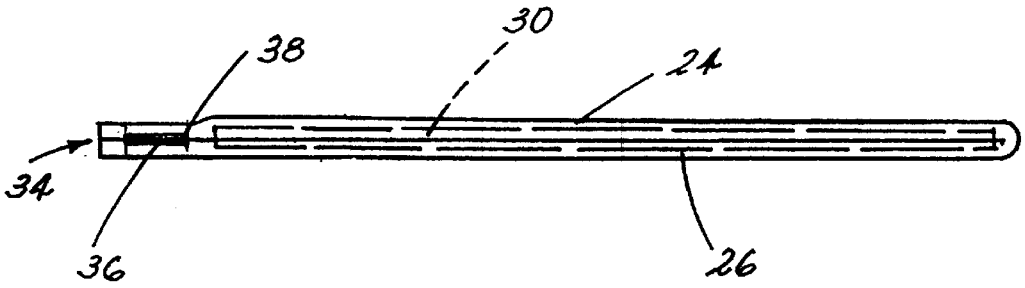
FIG. 3B is a side view of an alternative embodiment of a cymbal sleeve.

In FIGS. 3A and 3B, an alternative embodiment is disclosed in which no closure flap is provided. Rather, the main mouth opening 34 for receiving the cymbal is secured closed with securing strip 32. The locking and anchoring members 36, 38 respectively, that form the securing strip are disposed along the interior edge of the top and bottom portions 24, 26 of the cymbal sleeve near the mouth opening 34.

Figure 4:
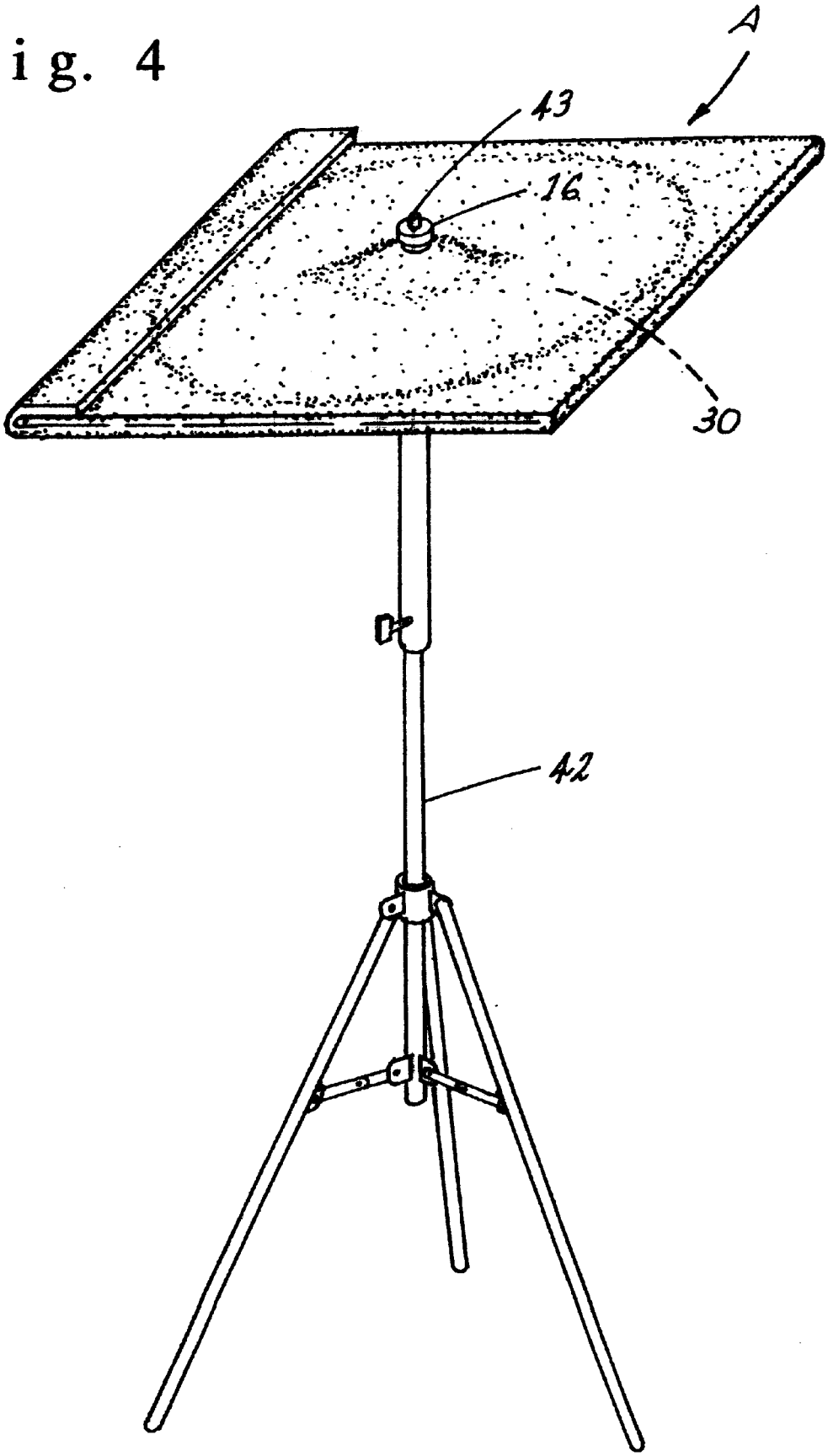
FIG. 4 is a perspective view of a cymbal sleeve containing a cymbal mounted on a cymbal stand.

FIG. 4 illustrates the cymbal sleeve A, containing a cymbal 30, placed upon a cymbal stand 42 having a post 43 and securing nut 16. This allows a cymbal to be protected while not in use, but still placed upon the cymbal stand.

Figure 5:
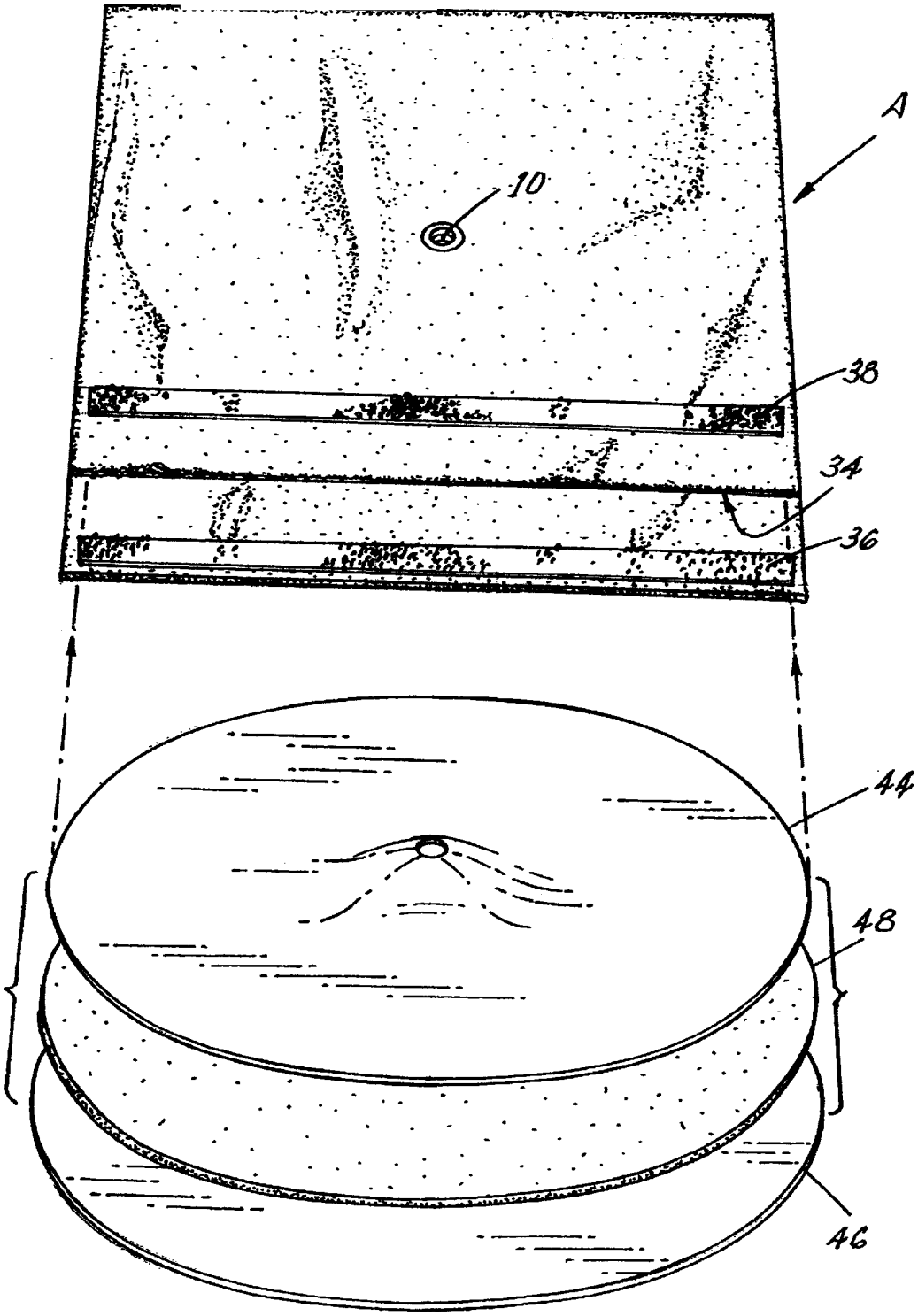
FIG. 5 is a perspective view of two cymbals and an inner cushion being inserted into a cymbal sleeve.

FIG. 5 shows the ability to protect two cymbals within a single cymbal sleeve such as is necessary with a hi-hat cymbal. A hi-hat cymbal comprises top cymbals mounted with one above the other so that they can open and close together. These cymbals are of the same diameter and can be stored with a single cymbal sleeve. Top hi-hat cymbal 44 and bottom hi-hat cymbal 46 are stacked on top of each other with an inner cushion 48 placed between the top and bottom hi-hat cymbal. The top and bottom hi-hat, and sandwiched inner cushion are then placed in cymbal sleeve A. When the center opening of the cymbal sleeve, the opening of the hi-hat cymbals and the opening of the inner cushion are aligned, the cymbals, inner cushion and cymbal sleeve can be mounted to the securing post of a cymbal stand or case, thereby preventing damage to the cymbals during transportation, setup or teardown.

While a preferred embodiment of the invention has been described using specific terms, such description is for illustrative purposes only, and it is to be understood that changes and variations may be made without departing from the spirit and scope of the claims below. Other embodiments and modifications may become apparent to those skilled in the art upon reading the foregoing specification, but such modifications and embodiments may be within the scope of the invention that is limited only by the claims below.

What is claimed is:

1. A cymbal sleeve comprising:

a top portion;

a bottom portion joined along a portion of its perimeter to the corresponding perimeter of the top portion forming a pocket;

a mouth formed by the unjoined portion of the perimeters of said top and bottom portions for receiving a cymbal;

said top portion having a top post opening generally located within the center of said top portion; and said bottom portion having a bottom post opening generally located within the center of said bottom portion, said top post opening and said bottom post opening being aligned with the cymbal opening for allowing the post of a cymbal case to be received through the bottom portion, cymbal, and top portion for securing the cymbal and protective cymbal sleeve in the cymbal case.

2. The cymbal sleeve of claim 1 further comprising closure means disposed along the interior edge of said top and bottom portions near said mouth for closing said mouth.

3. The cymbal sleeve of claim 2 wherein said closure means has a locking member and an anchor member, said anchor member being carried by said top portion and said locking member being carried by said bottom portion so that when said locking member and said anchor member are engaged, said top portion is secured to said bottom portion and thereby closing said mouth for providing a securely closed cymbal sleeve for holding at least one cymbal.

4. The cymbal sleeve of claim 1 further comprising a closure flap carried by said bottom portion disposed near said mouth, said closure flap being foldable over said top portion for closing said mouth.

5. The cymbal sleeve of claim 4 wherein:

said closure flap has a secured end and a free end, said secured end being carried by said bottom portion; and a securing strip having a locking member and an anchor member, said anchor member being carried by said top portion and said locking member carried by said free end of said closure flap so that when said locking member and said anchor member are engaged, said closure flap is secured to said top portion providing a securely closed cymbal sleeve for holding at least one cymbal.

6. The cymbal sleeve of claim 1 further comprising a closure strap carried by said bottom portion disposed near said mouth, said closure strap being foldable over said top portion for closing said mouth.

7. The cymbal sleeve of claim 6 wherein:

said closure strap has a secured end and a free end, said secured end being carried by said bottom portion; and a securing strip having a locking member and an anchor member, said anchor member being carried by said top portion and said locking member carried by said free end of said closure strap so that when said locking member and said anchor member are engaged, said closure strap is secured to said top portion providing a securely closed cymbal sleeve for holding at least one cymbal.

8. The cymbal sleeve of claim 1 further comprising a top post opening reinforcement member and a bottom post opening reinforcement member for providing protection against wear due to the action of mounting and dismounting the cymbal sleeves on cymbal case posts and cymbal stand posts.

9. A cymbal sleeve for protection of a cymbal within a cymbal case or on a cymbal stand comprising:

a cymbal pocket having a top portion and a bottom portion joined together along a portion of the perimeter;

said cymbal pocket having a mouth for receiving a cymbal formed by the unjoined portion of the perimeters of said top and bottom portions;

said cymbal pocket having a top post opening within said top portion generally located in the center of said top portion; and said bottom portion of said cymbal pocket having a bottom post opening generally located in the center of said bottom portion, said top post opening and said bottom post opening corresponding to the opening in a cymbal where said cymbal is received within said cymbal pocket for mounting said cymbal and said cymbal sleeve to a post of a cymbal stand or cymbal case.

10. The cymbal sleeve of claim 9 further comprising closure means disposed along the interior edge of said top and bottom portions near said mouth for securing said mouth in a closed position to close said cymbal pocket when a cymbal is received within said cymbal pocket.

11. The cymbal sleeve of claim 10 wherein said closure means further comprises a securing element for securing said mouth in a closed position.

12. The cymbal sleeve of claim 11 wherein said securing element further comprises:

a locking member connected to said bottom portion; and an anchor member connected to said top portion so that when said mouth is in said closed position, said locking member engages said anchor member securing said mouth in said closed position.

13. The cymbal sleeve of claim 9 further comprising a flap extending from said pocket for folding over said mouth in a closed position to close said cymbal pocket when a cymbal is received within said cymbal pocket.

14. The cymbal sleeve of claim 13 further comprising a securing element for securing said flap in said closed position.

15. The cymbal sleeve of claim 14 wherein said securing element further comprises:

a locking member connected to said flap; and an anchor member connected to said pocket so that when said flap is in said closed position, said locking member engages said anchor member securing said flap in said closed position.

16. The cymbal sleeve of claim 14 wherein said securing element further comprises:

a locking member connected to said strap; and an anchor member connected to said pocket so that when said strap is in said closed position, said locking member engages said anchor member securing said strap in said closed position.

17. The cymbal sleeve of claim 9 further comprising a strap extending from said pocket for folding over said mouth in a closed position to close said cymbal pocket when a cymbal is received within said cymbal pocket.

18. The cymbal sleeve of claim 17 further comprising a securing element for securing said strap in said closed position.

19. The cymbal sleeve of claim 9 further comprising;

a inner cushion for placement between two cymbals for allowing two cymbals to be placed in a single cymbal sleeve.

20. A method for protecting a cymbal comprising the steps of:

providing a cymbal;

providing a sleeve having a top protection portion with a center opening and a bottom protection portion with a center opening, said openings being aligned one with the other;

providing a mouth along an edge of said sleeve forming an opening into an area between said top and bottom portions;

placing a cymbal through said mouth into said area of said sleeve;

placing said cymbal and said sleeve upon a cymbal case post.

21. The method of claim 20 further comprising the steps of securing said cymbal to said cymbal case post.

22. The method of claim 21 further comprising the step of repeating the above steps for a plurality of cymbals.

23. The method of claim 20 further comprising the steps of:

providing a plurality of cymbals;

placing an inner cushion between said cymbals; and placing said cymbals and said inner cushions within said pocket.

24. A method for protecting cymbals comprising the steps of:

providing a cymbal;

inserting a cymbal in a cymbal sleeve having a center opening corresponding to the center opening of a cymbal; and securing said cymbal and said cymbal sleeve within a cymbal case.

25. The method of claim 24 further comprising the step of repeating the above steps for a plurality of cymbals.

26. The method of claim 24 further comprising the steps of placing said cymbal received within said cymbal sleeve on a cymbal stand.

27. A cymbal case for protecting cymbals comprising:

a case housing having a post carried generally in the center of the interior of said case housing;

a cymbal pocket having a mouth for receiving a cymbal; and an opening disposed generally in the center of said cymbal pocket and generally aligned with the hole in a cymbal for receiving said post to secure said cymbal and said cymbal pocket to said case housing.

28. The cymbal case of claim 27 wherein said cymbal pocket has a top portion and a bottom portion.

29. The cymbal case of claim 28 further comprising reinforcements around said opening for protecting said opening from wear and tear when mounting and dismounting said cymbal sleeve to said post.

30. The cymbal case of claim 27 further comprising a securing member adapted to be received on said post for securing said cymbal sleeve and said cymbal to said post.

31. The cymbal case of claim 30 further comprising;

a case top which can be placed on said case housing to completely enclose said cymbal sleeves mounted within said case housing; and securing straps to secure said case top to said case housing.

* * * * *